US005588601A

United States Patent [19]

Korber

[11] Patent Number: 5,588,601

[45] Date of Patent: Dec. 31, 1996

[54] YARN WINDING METHOD AND APPARATUS FOR CARRYING OUT SAME

[75] Inventor: Ralf Korber, Remscheid, Germany

[73] Assignee: Barmag AG, Remscheid, Germany

[21] Appl. No.: 256,843

[22] PCT Filed: Nov. 5, 1993

[86] PCT No.: PCT/EP93/03104

§ 371 Date: Jul. 26, 1994

§ 102(e) Date: Jul. 26, 1994

[87] PCT Pub. No.: WO94/12421

PCT Pub. Date: Jun. 9, 1994

[30] Foreign Application Priority Data

Nov. 26, 1992 [DE] Germany ..... 42 39 752.9

[51] Int. Cl.[6] ..... B65H 67/044; B65H 54/00

[52] U.S. Cl. ..... 242/18 EW; 242/18 A

[58] Field of Search ..... 242/18 EW, 18 A, 242/25 A

[56] References Cited

U.S. PATENT DOCUMENTS

| | | | |
|---|---|---|---|
| 3,907,217 | 9/1975 | Graf et al. . | |
| 4,138,072 | 2/1979 | Aoyama et al. | 242/18 EW X |
| 4,339,089 | 7/1982 | Dobbins | 242/18 A |
| 4,948,058 | 8/1990 | Behrens et al. | 242/18 A |
| 5,016,829 | 5/1991 | Schippers et al. | 242/18 A |
| 5,029,762 | 7/1991 | Behrens et al. | 242/18 A |
| 5,318,232 | 6/1994 | Busenhart et al. | 242/18 A |

FOREIGN PATENT DOCUMENTS

| | | |
|---|---|---|
| 225049 | 8/1910 | Germany . |
| 2328828 | 12/1973 | Germany . |
| 2506930 | 9/1976 | Germany . |
| 4023291 | 5/1992 | Germany . |

OTHER PUBLICATIONS

*Fiber Producer*; Aug. 1979; pp. 20 and 21.

*Primary Examiner*—Daniel P. Stodola
*Assistant Examiner*—Michael R. Mansen
*Attorney, Agent, or Firm*—Bell, Seltzer, Park & Gibson, P.A.

[57] ABSTRACT

A method and apparatus for winding a yarn wherein at the end of the winding cycle the yarn end is secured to the package surface, so as to prevent yarn layers from automatically sliding down in subsequent handling and transportation of the packages. In accordance with the invention, the advancing yarn (1) is lifted out of the yarn traversing mechanism (2) at the end of the winding cycle, and guided and wound in a narrow axial range of the package (8). In the slowdown phase of the package (8), a pressing device (12–14) is pivoted against the package surface, which presses the yarn end by an adjustable force into the formed yarn bead.

29 Claims, 2 Drawing Sheets

YARN WINDING METHOD AND APPARATUS FOR CARRYING OUT SAME

BACKGROUND OF THE INVENTION

The present invention relates to a method and apparatus for winding a yarn into a cross wound package, and having provision for securing the free yarn end to the package at the conclusion of the winding operation.

The spinning of synthetic fibers, especially an automated spinning process, have in the past presented difficulties in protecting the free yarn end of the package removed from the takeup machine at the end of a winding cycle against contamination during its transportation, and in particular, in locating it again after transportation to a further processing station. Until now, attempts known from the prior art and directed to the identification of the yarn end in the winding of an endless filament yarn at the end of a winding cycle, so that it is again easily locatable, have been unsuccessful.

For example, in a method known from DE 40 23 291 A1, the yarn end of a cross-wound package is easier to locate in that for purposes of forming a yarn reserve upon reaching a certain package diameter or a certain amount of yarn, the yarn is guided across the peripheral surface to the tube or along a secant line across the end surface of the package, and subsequently returned to its peripheral surface.

According to the method described in DE 25 06 930 A1, for purposes of facilitating the locating of the yarn end, a yarn reserve is likewise formed at the end of the winding cycle. To this end, the package is removed from the takeup device and rotated slowly in opposite direction to the direction of winding, the yarn end being grasped pneumatically and sucked off by a yarn suction device. Subsequently, the opening of the yarn suction device swings toward one end of the winding tube projecting from the package, whereupon the yarn is delivered by the yarn suction device to the winding tube, or blown into the winding tube, or wound about the end of the Winding tube in that the package is again rotated in its direction of winding.

While the first-mentioned method has not been suitable to ensure a troublefree relocating of the yarn end, it has been possible to use the second method in takeup machines for an automated spinning only after doffing the package from the winding spindle.

In takeup devices, on which the present invention is based, the yarn is lifted out of the yarn traversing mechanism at the end of the winding cycle, and until it is cut, it advances, guided by a suitable auxiliary device, onto the package in a narrow axial region of the decelerating package, thereby forming a bead-shaped, narrow accumulation of yarn (note, for example, DE 23 28 828 C2).

It is therefore the object of this invention to provide a simple and low-cost possibility of securing the free yarn end upon termination of the winding cycle such that it is easy to relocate during the further handling of the package.

SUMMARY OF THE INVENTION

The above and other objects and advantages of the present invention are achieved by the provision of a method and apparatus for winding a continuously advancing yarn onto a rotating bobbin, and which comprises the steps of winding the advancing yarn onto the rotating bobbin while traversing the yarn at a location upstream of the bobbin to thereby form a rotating cross wound package. The traverse of the advancing yarn is then terminated, and the yarn is then deposited on the rotating package in an axially narrow region of the package surface so as to form a yarn accumulation. Thereafter the advancing yarn is severed to form a free yarn end, and the free yarn end is then pressed into the yarn accumulation on the surface of the rotating package, and such that the free yarn end is secured to the package and is easily locatable.

It has shown that this simple measure permits to deposit the yarn end into the yarn bead forming on the package as it slows down, so as to secure it, on the one hand, in an adequate manner especially for internal transportation, and on the other hand, however, to make it possible to locate it again easily for the further processing of the package, for example, by means of a suction device, brushes, or the like.

Suitably, the pressing device as used in accordance with the invention only while the full package slows down, is swung during the winding operation and the package doff, as well as during a shutdown of the machine, to an idle position removed from the takeup device. It is applied to the package surface only in the slowdown phase. Depending on the type of construction of the takeup machine, is necessary in this process to move the winding spindle away from a contact or drive roll, or in the case of a takeup machine with several winding spindles arranged on a revolver, to move the package, as it slows down, to its doffing position, and to apply the pressing device to the package surface only in this position.

The application or placing of the pressing device on the package surface may occur in different ways. Thus, for example, as the package slows down, it may be placed on the circumference of the package, for example, prior to the last three to seven package revolutions, and remain there until the package comes to a complete stop.

In a preferred embodiment, after completion of the winding cycle, the package is braked until it stops. Then, the pressing device is placed on the stopped package, and the package is subsequently set again into rotation, at a slow speed, for approximately three to seven additional revolutions.

This invention is used no matter whether the package is formed on an empty tube, which is clamped on a winding spindle driven by a coaxial drive motion, or on a freely rotatable winding spindle, which is rotated by a surface drive.

In takeup devices, in which at least two winding spindles are supported on a package revolver axially projecting therefrom, and which alternate between a winding and a doffing position, it is preferred to apply the pressing device to the package surface, when the full package is in its doffing position at the end of the winding cycle.

The yarn end may be pressed into the bead forming as a result of accumulating the yarn by the action of gravity or by an adjustable force. In the latter instance, the takeup device is equipped in accordance with the invention with a pressing device. Same may consist of a rocking lever unilaterally supported in a pivot bearing and a contact element attached to the free end of the lever, and for embedding the yarn end in the narrow contact region of the yarn removed from the yarn traversing mechanism, it may be placed on the surface of the decelerating package. The pressure applied by the contact element should not exceed, if possible, the contact pressure under which the drive roll rests against the package surface.

A drive which has shown to be well suited for engaging on the pivoting arm of the pressing device, for example, is a cylinder-piston unit which is suitably arranged, via a first pivot bearing on the machine frame and with the free end of its piston rod, on a further pivot bearing provided on the arm of the pressing device. This drive may also be used to swing the pressing device away from the package surface during the winding and the doffing operation.

In the simplest case, the contact element may be a pressure shoe which is fixedly attached to the free end of the rocking lever, and which is, for example, molded to the rocking lever. In some instance, it may be advantageous to construct the free end of the pressure shoe as a forked yarn guide, so as to keep the yarn in the region of the bead while it is formed.

In particular, when winding finer yarn deniers, the use of a freely rotatable, and especially easily rotatable pressing roll attached to the free end of said rocking lever has turned out to be useful. It has shown that for a reliable prevention of damage to the package surface, it can be advantageous, when the pressing roll has a length which extends over a substantial length of the package.

In the simplest case, the pressing roll may be circular-cylindrical. Since in many cases, the surface of the finished package, when viewed in its axial direction, has a slightly concave shape, it may be advantageous for obtaining a largest possible contact surface of the pressing roll, when same receives a convexly bulged shape. It has shown that it will be possible to obtain an improvement in the adherence of the yarn end in the bead-shaped yarn accumulation, when the individual or individual yarn windings of the beaded yarn accumulation are shifted against one another. A suitable means to this end has turned out to be the arrangement of a recess or groove in the surface of the pressing roll, namely in the region which contacts the yarn accumulation. The width of the recess should slightly exceed that of the accumulated yarn, its depth, however, should be less than the height of the accumulated yarn. When the recess has a width slightly larger than that of the accumulated yarn, it may have in its central region a radially inward directed bulging, as a result of which the central region of the recess has a lesser depth than its marginal regions.

In any event, the depth of the recess and the radial thickness of the yarn accumulation should be adapted to one another such that the roll rests on the package surfaces on both sides of the yarn accumulation.

Advantageously, the pressing roll may be formed by the outer ring of an antifriction bearing, in particular of a ball bearing, it being however necessary to see to it that the antifriction or ball bearing is effectively sealed on its sides against the penetration of fiber remnants and the like.

Particularly preferred is the use of the pressing device for the yarn end in takeup machines, which are suitable for a continuous winding operation, and in which several winding spindles receive the yarn successively or alternately, and transfer same during a package doff without waste.

BRIEF DESCRIPTION OF THE DRAWINGS

The invention is described with reference to a preferred embodiment illustrated in the drawing, in which.

DETAILED DESCRIPTION OF THE PREFERRED EMBODIMENTS

Figure 1:
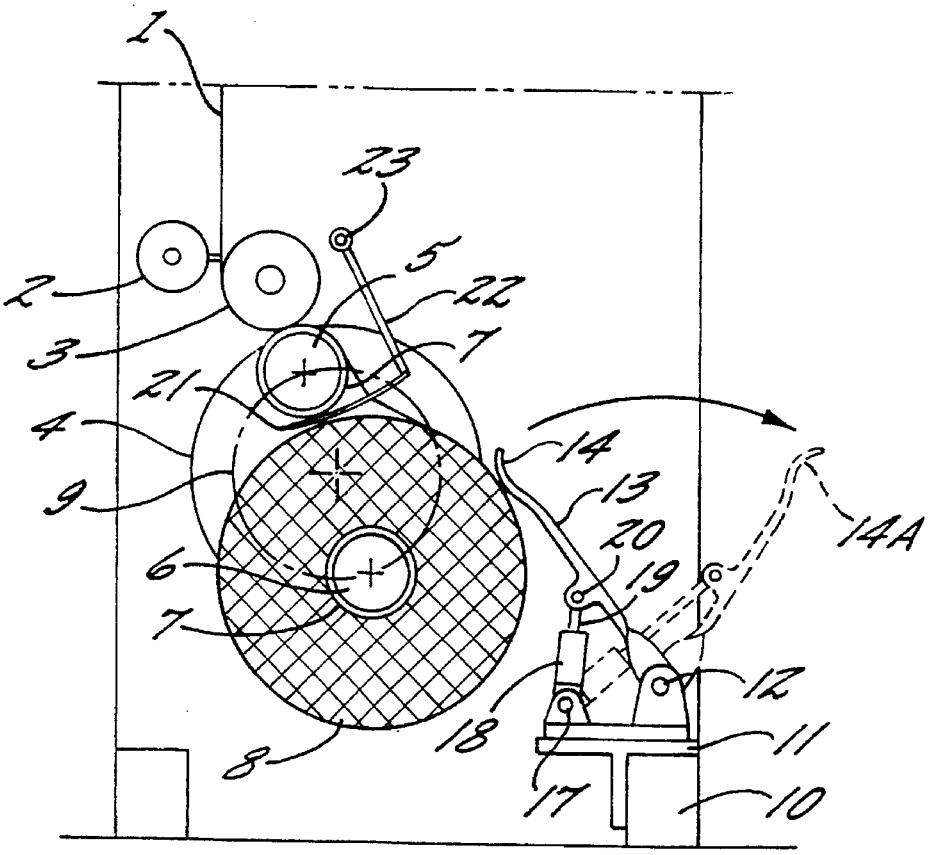
FIG. 1 a side view of a takeup device equipped with a pressing device in accordance with the invention.

Shown in FIG. 1 is in simplified depiction the side view of a takeup position, which comprises a yarn traversing mechanism 2, a drive roll 3, and a package revolver 4 equipped with two winding spindles 5, 6. Accommodated on winding spindle 5 is an empty tube 7 resting against drive roll 3, whereas the second winding spindle 6 carries a full package 8, which has already been moved along a turning circle 9 to its doffing position. Further shown, attached to a lever 22 pivoting about a pivot bearing 23 is a partition sheet 21, which is pivoted between empty tube 7 and package 8 upon reaching the illustrated situation.

A yarn 1 which is lifted out of traversing mechanism 2 during the package doffing operation, continues to advance initially over drive roll 3 and empty tube 7 toward full package 8. In so doing, it is guided between empty tube 7 and full package 8 in a yarn guide slot arranged in partition sheet 21, which has been moved in after lifting the yarn out of the traversing mechanism. A pressing lever 13 is placed on the bead forming as a result of the yarn accumulation 16, and it sees to it that after cutting the yarn on empty tube 7, the yarn end is pressed into the bead. The rocking lever 13 of the pressing device 12–14 shown in FIG. 1 is jointed via a pivot bearing 12 to a bracket 11 arranged on machine frame 10. A pressing shoe 14 molded to its free end rests against the package surface in the region of the yarn accumulation 16.

Likewise jointed to bracket 11, via a pivot bearing 17, is cylinder 18 of a cylinder-piston unit 18, 19. The free end of piston rod 19 is connected, via a pivot bearing 20, with rocking arm 13 of pressing device 12–14, so as to permit pressing shoe 14 to contact the package surface under a force which can be selected by a corresponding biasing of cylinder-piston unit 17–20. In like manner, pressing device 12–14 can be pivoted out of the winding range, for example, to its swung-out position 14A shown in dashed lines, so as not to obstruct the package doff and winding operation.

Figure 2:
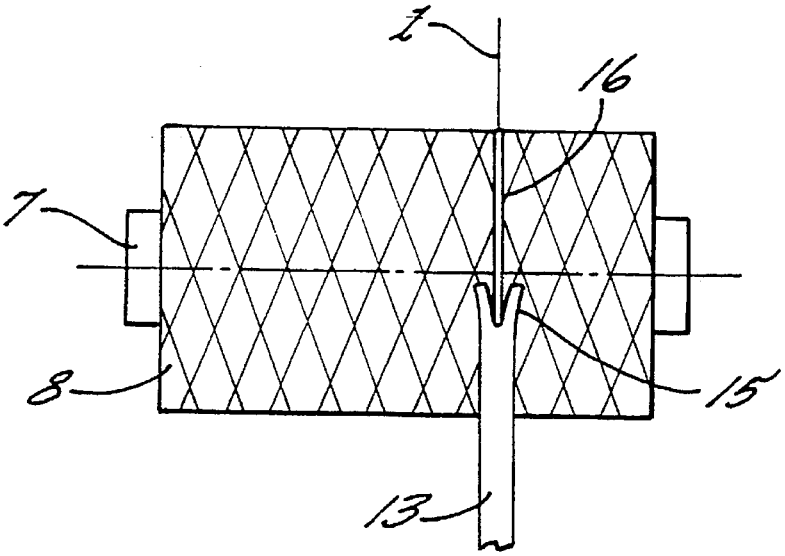
FIG. 2 shows a package with a pressing shoe resting against a beaded yarn accumulation.

FIG. 2 is a side view of full package 8 with rocking lever 13 resting against its wound surface. In the illustrated embodiment, a pressing shoe 15 has the shape of a fork, and rests against the yarn winds 16 formed by the yarn end.

Figure 3:
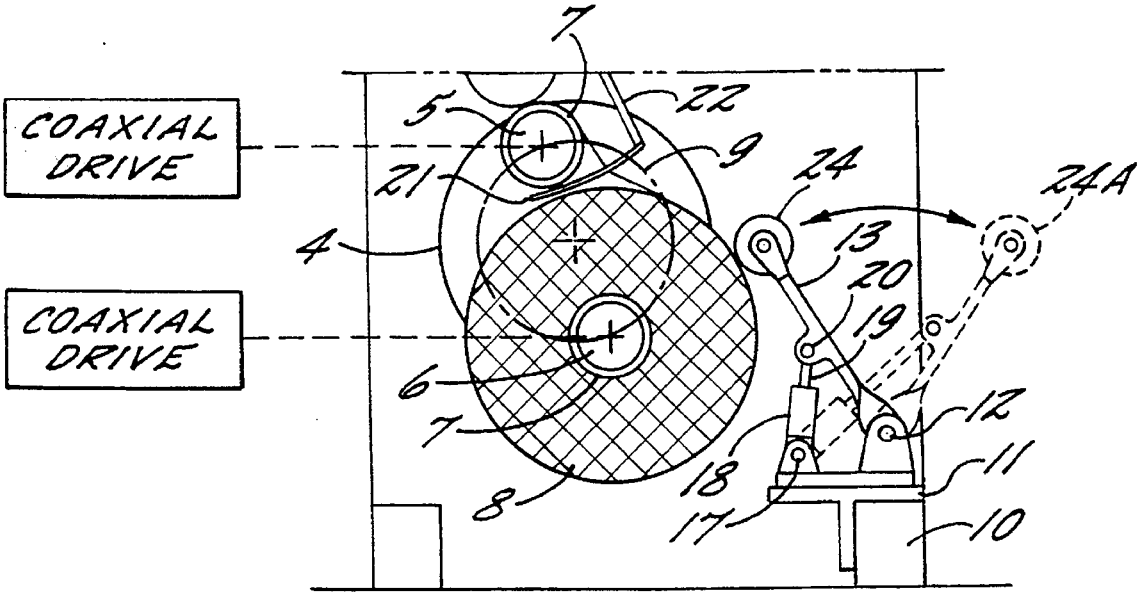
FIG. 3 is a side view in accordance with FIG. 1, using however a pressing roll as pressing device.
Figure 4:
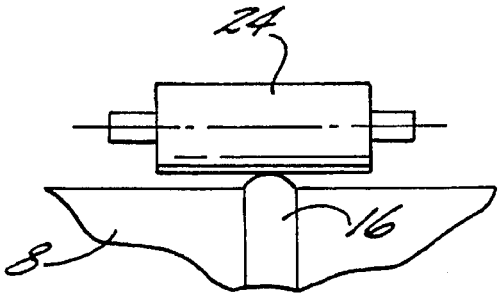
FIG. 4 is an axial sectional view of a cylindrical pressing roll resting against a beaded yarn accumulation.

It has been found that in the winding of a higher-denier yarn material, in particular filaments having a coarser denier, the contact element constructed as pressing shoe 14 can be used in by far most cases without damaging the yarn material. Contrary thereto, in the winding of finer deniers, in particular finer individual deniers, such as microfilaments, is has been found that the use of a contact roll 24 is to be preferred over the contact element of the present invention. Therefore, as shown in FIG. 3, a freely rotatable, preferably easily rotatable, pressing roll 24 may be provided at the free end of rocking lever 13 in the place of a pressing shoe 14.

Shown in FIGS. 4–7 are different embodiments which are suitable to this end. In this connection, it should be remarked that to guarantee that little contact force is exerted by pressing roll 24 on the package surface with an adequate contact pressure in the region of yarn accumulation 16, it has shown useful in many instances to select the length of pressing roll 24 such that it covers a substantial partial length of package 8.

Figure 5:
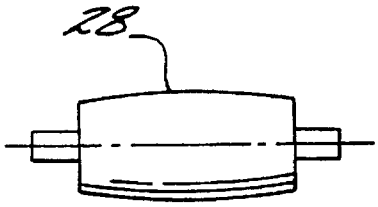
FIG. 5 is an axial sectional view of a bulged pressing roll.
Figure 6:
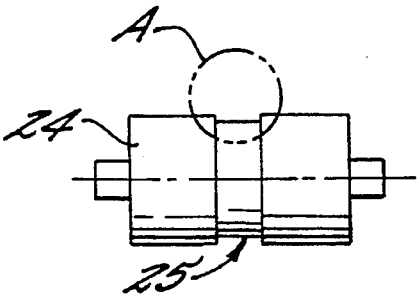
FIG. 6 is an axial sectional view of a pressing roll with a recess.
Figure 7:
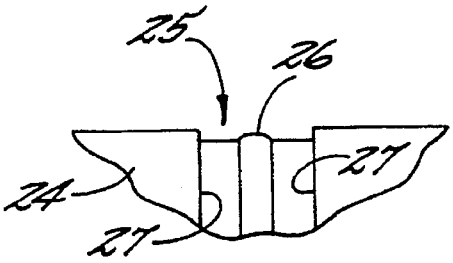
FIG. 7 is a sectional view of a recess with a radially outward directed bulging.

Whereas pressing roll 24 resting on a yarn accumulation 16 is circular-cylindrical in its shape, the pressing roll of FIG. 5 has a bulged surface 28. It should be indicated, in this connection, that the bulging is exaggerated for the sake of a better illustration.

Surprisingly, it has been found that the arrangement of a recess 25 in region of the surface of pressing roll 24 resting against yarn accumulation 16, will lead to an improved adherence of the yarn end in the yarn accumulation, when its depth is dimensioned so that during contacting, the individual or individual yarn winds of yarn accumulation 16 are shifted against one another. In so doing, a further improvement of the effect may be achieved by providing in the central region of recess 25 a bulging 26 is which projects radially above the bottom of the recess. The depth of the recess in the region of its edges 27 as well as the amount, by which bulging 26 projects radially, are advantageously to be dimensioned such that, while the former is smaller than the unloaded height of yarn accumulation 16 projecting beyond the package surface, it is ensured that the surface of pressing roll 24 still rests against the package surface extending outside of edges 27.

It should still further be indicated that in the production of several wound packages side by side on a single winding spindle 5, 6, the associated pressing rolls 24 are arranged on a common shaft, and that each is provided with a corresponding recess 25, bulging 26, or bulged contact surface 28. Each of them should be provided axially spaced apart at the point, where the yarn accumulation in the form of an annular bead is formed at the end of the winding cycle.

While in the foregoing description the invention has been depicted with reference to a takeup device with package revolver 4 and drive roll 3, it is however within the discretion of the person skilled in the art to use the invention also in the instance of a different kind of drive for the winding spindle, for example, coaxial drive motors as illustrated schematically in FIG. 3 of the drawings, or in the instance of a takeup device constructed without a package revolver.

I claim:

1. A method of winding a continuously advancing yarn onto a rotating bobbin to form a yarn package and comprising the steps of winding the advancing yarn onto the rotating bobbin while the bobbin is mounted on a winding spindle, and while traversing the yarn at a location upstream of the bobbin to thereby form a rotating cross wound package, terminating the traverse of the advancing yarn and then depositing the yarn on the rotating package on said winding spindle in an axially narrow region of the package surface so as to form a yarn accumulation, severing the advancing yarn to form a free yarn end, and pressing the free yarn end into the yarn accumulation on the surface of the rotating package, and such that the free yarn end is secured to the package and easily locatable.

2. A method as defined in claim 1 wherein the pressing step includes moving a pressing device from an idle position removed from the package to an operative position in contact with the package surface while the bobbin is mounted on said winding spindle.

3. The method as defined in claim 2 including the further step of decelerating the rotating package to a standstill, and wherein the pressing device is moved from its idle position to its operative position during the deceleration of the rotating package.

4. The method as defined in claim 3 wherein the pressing device is moved from its idle position to its operative position during the last several revolutions of the rotating package before reaching a standstill.

5. The method as defined in claim 2 comprising the further step of decelerating the rotating package to a standstill, and wherein the pressing device is moved from its idle position to its operative position after the package reaches a standstill, and wherein the package is thereafter again rotated at a relatively slow speed with the pressing device remaining in its operative position and while the bobbin is mounted on said winding spindle.

6. The method as defined in claim 2 wherein the pressing device is applied to the surface of the rotating package with an adjustable force.

7. The method as defined in claim 1 wherein the bobbin is a tube which is coaxially mounted on a winding spindle, with the winding spindle being driven by a coaxial drive motor.

8. The method as defined in claim 1 wherein the bobbin is a tube which is coaxially mounted on a winding spindle, with the winding spindle being driven by surface contact with a rotating drive roller.

9. A method of winding a continuously advancing yarn onto a rotating bobbin to form a yarn package, and comprising the steps of winding the advancing yarn onto a rotating bobbin positioned on a winding spindle at a winding position and including traversing the yarn at a location upstream of the winding position to thereby form a cross wound package on the bobbin, laterally moving the winding spindle and the rotating bobbin from said winding position to a doffing position upon the package becoming full, terminating the traverse of the advancing yarn and then depositing the yarn on the rotating full package on said winding spindle in an axially narrow region of the package surface so as to form a yarn accumulation, severing the advancing yarn to form a free yarn end, and pressing the free yarn end into the yarn accumulation on the surface of the rotating package, and such that the free yarn end is secured to the package and is easily locatable.

10. The method as defined in claim 9 wherein the terminating, severing, and pressing steps occur subsequent to the full package being laterally moved to the doffing position.

11. An apparatus for winding a continuously advancing yarn onto a rotating bobbin to form a yarn package, and comprising a spindle adapted to coaxially mount a bobbin, means for rotating the spindle and a bobbin mounted thereon, means for winding the advancing yarn onto a rotating bobbin which is mounted on said spindle while traversing the yarn at a location upstream of the bobbin to thereby form a rotating cross wound package, means for terminating the traverse of the advancing yarn and then depositing the yarn on the rotating package in an axially narrow region of the package surface so as to form a yarn accumulation, means for severing the advancing yarn to form a free yarn end, and means for pressing the free yarn end into the yarn accumulation on the surface of the rotating package while mounted on the spindle, and such that the free yarn end is secured to the package and easily locatable.

12. The apparatus as defined in claim 11 wherein the pressing means comprises a contact element, means pivotally mounting the contact element about a pivot axis which is parallel to the axis of said spindle, and control means for selectively moving the contact element between an idle position removed from the package to an operative position in contact with the package surface.

13. The apparatus as defined in claim 12 wherein the contact element rests freely against the surface of the package.

14. The apparatus as defined in claim 12 wherein the control means includes biasing means for positively pressing the control element against the surface of the package.

15. The apparatus as defined in claim 14 wherein said biasing means is a cylinder-piston unit which is pivotally connected to the contact element.

16. The apparatus as defined in claim 12 wherein the contact element is a pressing shoe (14) attached to the free end of a rocking lever (13).

17. The apparatus as defined in claim 16 wherein the pressing shoe is integral with the rocking lever.

18. The apparatus as defined in claim 16 wherein the pressing shoe includes a forked extension (15) at its free end.

19. The apparatus as defined in claim 12 wherein the contact element is a pressing roll (24) rotatably mounted to the free end of a rocking lever (13).

20. The apparatus as defined in claim 19 wherein the pressing roll has a length extending over a substantial portion of the length of the package.

21. The apparatus as defined in claim 19 wherein the pressing roll has a cylindrical outer surface.

22. The apparatus as defined in claim 19 wherein the pressing roll is convexly bulged in axial cross-section.

23. The apparatus as defined in claim 19 wherein the pressing roll includes a circumferential recess positioned to receive the yarn accumulation.

24. The apparatus as defined in claim 23 wherein the recess includes an annular bulge (26) located centrally therein.

25. The apparatus as defined in claim 23 wherein the depth of the recess and the radial thickness of the yarn accumulation are adapted to one another such that the pressing roll rests against the package surface on both sides of the yarn accumulation.

26. An apparatus for winding a continuously advancing yarn onto bobbins serially delivered to a winding position and without yarn stoppage between bobbin changes, and comprising a bobbin revolver mounting at least two bobbin receiving spindles having parallel axes, and means for sequentially rotating the bobbin revolver so that each of the spindles may be alternately moved between a winding position and a doffing position, means for traversing the yarn across a bobbin which is mounted on a spindle in the winding position, and while rotatably driving such bobbin, yarn changeover means which is operable upon the revolver moving a rotating full bobbin from the winding position to the doffing position and moving an empty bobbin from the doffing position to the winding position, for terminating the traverse of the advancing yarn and then depositing the yarn on the rotating package in an axially narrow region on the package surface so as to form a yarn accumulation, and for then transferring the advancing yarn being wound on a rotating full bobbin at the doffing position onto the empty bobbin at the winding position, and so as to sever the yarn and leave a free yarn end on the rotating bobbin, and means for pressing the free yarn end into the yarn accumulation on the surface of the rotating package, and such that the free yarn end is secured to the package and easily locatable.

27. The apparatus as defined in claim 26 wherein the yarn changeover means includes a partition sheet (21) positioned for movement between the empty bobbin mounted at the winding position, and the full package rotated to its doffing positions, said sheet having a yarn receiving slot therein.

28. The apparatus as defined in claim 26 wherein the winding spindles are each provided with a coaxial drive.

29. The apparatus as defined in claim 26 wherein the winding spindles are each provided with a surface drive which includes a drive roll (3).

* * * * *